United States Patent [19]

Johns

[11] Patent Number: 4,616,770

[45] Date of Patent: Oct. 14, 1986

[54] QUILTING TOOL

[76] Inventor: Thelma D. Johns, 514 Fairway Dr., Kerrville, Tex. 78028

[21] Appl. No.: 786,060

[22] Filed: Oct. 10, 1985

[51] Int. Cl.[4] ..... D05B 91/04

[52] U.S. Cl. ..... 223/101; 2/21; D3/29

[58] Field of Search ..... 81/488; 30/324; 223/101; 2/21; 112/169; D3/29

[56] References Cited

U.S. PATENT DOCUMENTS

| | | | |
|---|---|---|---|
| 2,281,736 | 5/1942 | Wittenburg | 81/488 |
| 2,803,059 | 8/1957 | Murdock et al. | 30/324 |
| 3,014,277 | 12/1961 | Geckler | 30/324 |
| 3,261,237 | 7/1966 | Sentiff | 81/488 |
| 4,460,113 | 7/1984 | Nicklous | 223/101 |
| 4,534,495 | 8/1985 | Adkins | 223/101 |

*Primary Examiner*—Roscoe V. Parker

*Attorney, Agent, or Firm*—Norvell & Associates

[57] ABSTRACT

A tool for facilitating the hand sewing of a plurality of cloth laminations, such as the hand sewing of a quilt, comprises a handle portion conveniently held by the fingers of the hand of the user and having an integral tool portion shaped in the general outline of a spoon. The concave surface of the spoon shaped portion is engagable by the thumb or index finger of the user. The tip end of the spoon shaped portion is provided with a substantially flat or horizontal top surface which, when pressed upwardly against the cloth laminations to be sewn, effects a small ridge in such laminations, permitting the convenient insertion of the needle through the ridge and facilitating the production of a substantially uniform width of the successive stitches.

5 Claims, 8 Drawing Figures

QUILTING TOOL

BACKGROUND OF THE INVENTION

1. Field of the Invention

The invention relates to a hand held tool for expediting the sewing together a plurality of cloth laminations such as are found in the hand fabrication of a quilt.

2. Summary of the Prior Art

Quilting has been practiced for centuries. Most commonly, a plurality of squares or rectangles of colored cloths are sewn together around their peripheries to form the decorated top sheet.

The top sheet is overlaid on a liner, such as flannel, and a bottom are then sewed together to form the cloth, and these laminations are then sewed together to form the entire quilt. The stitches preferably form a uniform pattern across the entire area of the quilt, which requires thousands of hand stitches. In more recent times, enterprising manufacturers have printed a full sized sheet with an attractive decoration and this sheet is then sewn by hand stitches to one or more cloth laminations. The stitches are generally arranged in a square or rectangular pattern so as to simulate the old fashioned quilt when the product is finished.

In either event, thousands of hand stitches are required to complete a quilt and, in each stitch, the quilter must make sure that the needle penetrates all of the cloth laminations and then returns through the cloth laminations at a distance closely spaced from the point of entry so as to preferably give a relatively small stitch. Obviously, it is impractical for a quilter to pass the needle entirely through the cloth laminations and regrasp it on the underside of the cloth laminations and reinsert it on the return path through the laminations. Instead, the quilter generally wears a thimble, pushes the needle point through the cloth laminations in engagement with the thimble and then rotates the needle relative to the cloth so as to point the needle upwardly so that it may be pushed back through the cloth laminations. Such a time honored procedure requires the exercise of much diligence on the part of the quilter to insure that each stitch is substantially the same size as the preceeding stitch which, of course, contributes substantially to the aesthetic appearance of the finished quilt.

There has been, therefore, a definite need for a sewing or quilting tool for effecting the hand sewing of the plurality of cloth laminations to provide a uniformity of stitch which has heretofore been impossible to obtain except by the most skilled sewers.

SUMMARY OF THE INVENTION

The invention provides a tool for facilitating the hand sewing of a plurality of cloth laminations together, such as the cloth laminations commonly found in a quilt. The tool comprise a rounded or eliptical cross-section handle portion which has a tool portion integrally formed on one end of the handle portion. Preferably the handle is shaped so as to be snugly held by at least three fingers of one hand of the user. The tool portion can best be described as being spoon shaped in configuration and thus provides a concave surface against which either the ball of the thumb or the index finger may be placed to provide a rigidifying or stabilizing force to the tool permitting it to be held firmly in a substantially upright position beneath the plurality of cloth laminations to be sewn.

The top end of the spoon shaped tool portion is provided with a subtantially horizontal portion, preferably not exceeding $\frac{3}{8}$ths of an inch in length which, when pushed upwardly into the cloth laminations creates a small ridge in such laminations.

The needle is held in the other hand of the user above the cloth laminations and may be conveniently inserted through the cloth laminations just below the top of the ridge formed by the tool. Once inserted, a relaxation on the upward force of the tool will permit the needle to be pushed across the top end of the tool into the other side of the ridge of cloth laminations and a uniform stitch is thus assured.

Further advantages of the invention will be readily apparent to those skilled in the art from the following detailed description, taken in conjunction with the annexed sheets of drawings, on which is shown a preferred embodiment of the invention.

DESCRIPTION OF PREFERRED EMBODIMENT

Figure 1:
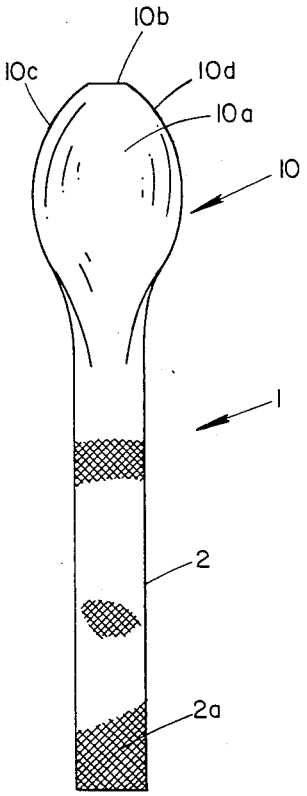
FIG. 1 is a front elevational view of a quilting tool embodying this invention.
Figure 2:
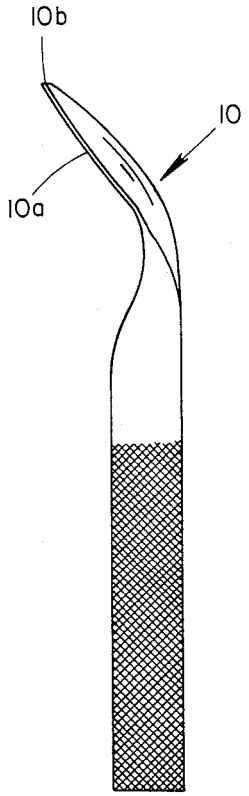
FIG. 2 is a side elevational view of FIG. 1.
Figure 3:
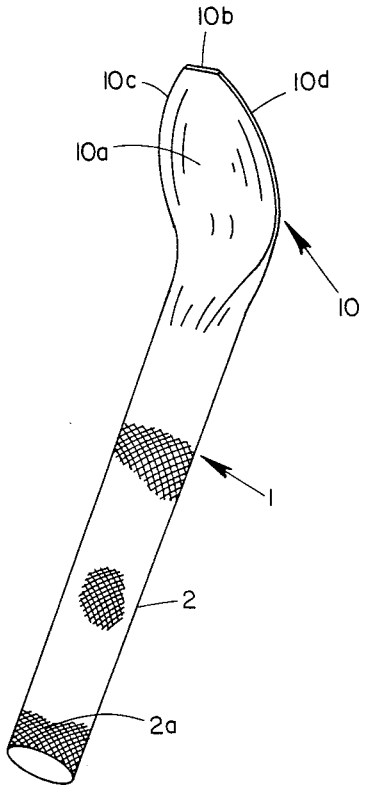
FIG. 3 is a perspective view of the tool shown in FIG. 1 and FIG. 2.

Referring to the drawings, the tool 1 embodying this invention comprises a handle portion 2 having either a circular or eliptical cross-section so as to be snugly and comfortably engaged by at least three fingers of the hand of the user. In other words, the peripheral surface of handle portion 2 comprises a surface generated by the movement of a line in an arcuate path about the longitudinal axis of the handle portion. Knurling 2*a* is preferably formed on handle portion 2 to facilitate the grip of the tool by the hand of the user.

The handle portion 2 is rigidly secured to, or integrally formed with a tool portion 10. Tool portion 10 can best be described as having a spoon shaped configuration, thus providing a concave surface 10*a* on one lateral side of the tool portion 10 for convenient engagement by the ball of the thumb or forefinger of the user, as illustrated in FIG. 4A.

The tool 1 is normally held in a substantially vertical position, and in this position the top end surface 10*b* of the spoon shaped tool portion 10 is formed as a substantially horizontal line disposed intermediate the arcuate peripheral portions 10*c* and 10*d* formed on the spoon shaped tool portion 10.

With the aforedescribed tool gripped by four fingers of the hand of the user and the thumb of the user resting firmly in the concave surface 10*a* of the spoon shaped tool portion 10, the substantially flat horizontal end surface 10*b* may be pushed upwardly into the cloth laminations to be sewn, represented by numeral L, thus forming an upstanding ridge R of such laminations which is of limited extent in both directions due to the limited length and width of the substantially flat surface 10*b*. Preferably the substantially flat end surface 10*b* is of a dimension not greater than 0.375 inches and preferably not less than 0.125 inches.

Figure 4A:
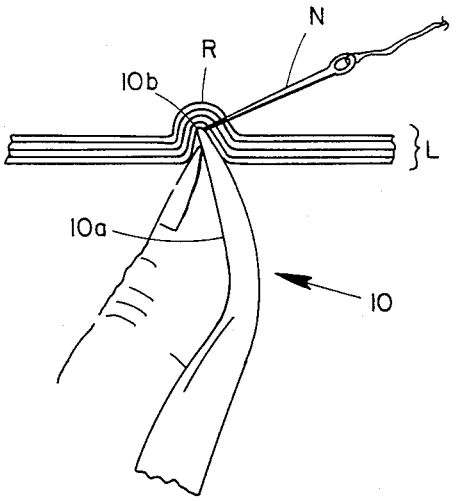
FIG. 4A is a schematic elevational view, partly in section, illustrating the first step in the use of the tool comprising the downward insertion of the needle through a plurality of cloth laminations.
Figure 4B:
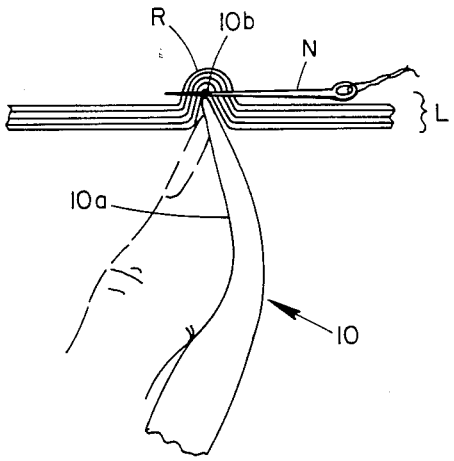
FIG. 4B is a view similar to FIG. 4A but illustrating the second step in the use of the tool comprising the upward reinsertion of the needle through the cloth laminations.

The needle end may thus be safely inserted through the cloth laminations at a substantial angle to the vertical, as shown in FIG. 4A without danger of striking any portion of the hand of the user disposed beneath the cloth laminations until the point of the needle strikes the convex surface 10*e* of the spoon shaped tool portion 10. At this point, as illustrated in FIG. 4*b*, the needle is pivoted to a substantially horizontal position to permit the tip of the needle to slide over the top end surface 10*b* of the tool 1 and the needle may then be readily inserted in the other side of the ridge R of cloth laminations L, following which the threaded needle may be pulled through to complete the stitch.

Figure 5:
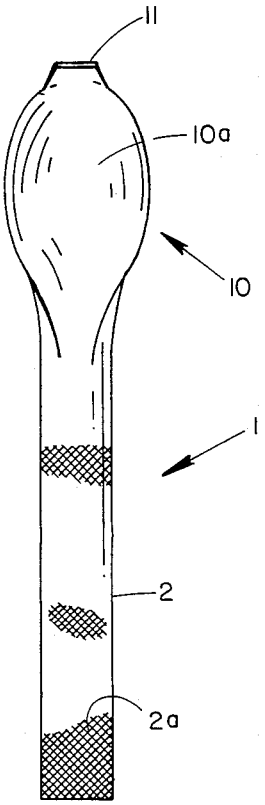
FIG. 5 is a front elevational view of a modified form of quilting tool embodying this invention.
Figure 6:
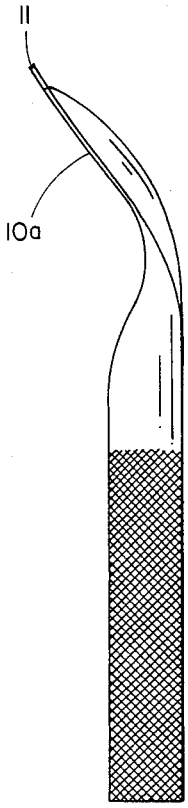
FIG. 6 is a side elevational view of FIG. 5.
Figure 7:
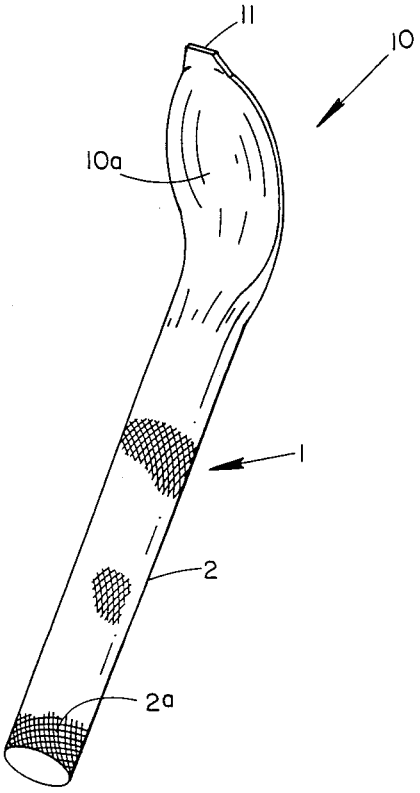
FIG. 7 is a perspective view of the tool shown in FIGS. 5 and 6.

Referring now to FIGS. 5–7, there is shown another embodiment of a quilting tool embodying this invention wherein the handle portion 2 and spoon shaped tool portion 10 are formed in the same manner as previously described. The spoon shaped tool portion 10 is, however, provided with an upwardly directed projection 11 which functions in the same manner as the substantially flat top surface 10*b* of the previously described modification. The projection 11 is preferably limited in width to a range from 0.125 inches to 0.375 inches and to a height not in excess of 0.25 inches. With such projection, the tool may be employed in the same manner as previously described in connection with FIGS. 4*a* and 4*b*, except the ridge R in the cloth laminations L is now formed by the relatively small projection 11 formed on the top or tip end of the spoon shaped tool portion 10.

It should be readily apparent to those skilled in the art that both embodiments of this invention permit the expeditious hand sewing of a plurality of cloth laminations with substantially uniform width stitches. The stitch width is primarily determined by the thickness of the top end of the spoon shaped tool portion. Generally a thickness in the range of 0.050 to 0.10 inches is preferred.

The employment of such tool substantially reduces the eye strain involved in attempting to make thousands of uniform width stitches and permits the stitching to proceed at a higher rate due to the confidence of the user that each stitch will be substantially the same width as the preceeding stitch. Obviously, there is little danger of the point of the needle striking the hand of the user holding the tool and, since the tool is conveniently held by the hand of the user, the generation of fatigue in such hand is minimized.

Although the invention has been described in terms of specified embodiments which are set forth in detail, it should be understood that this is by illustration only and that the invention is not necessarily limited thereto, since alternative embodiments and operating techniques will become apparent to those skilled in the art in view of the disclosure. Accordingly, modifications are contemplated which can be made without departing from the spirit of the described invention.

What is claimed and desired to be secured by Letters Patent is:

1. A quilting tool comprising a rod-like handle grippable by at least three fingers of the user, a spoon shaped tool portion rigidly secured to one end of said handle, said tool portion defining a concave surface snugly engagable by the thumb or index finger of the user, whereby said tool portion may be firmly held in a generally vertical position beneath a laminated assembly of cloths to be sewn, said spoon shaped portion having a generally horizontal top end portion having a horizontal length less than 0.375 inches engagable with the cloth laminations and shaped to form an upstanding, limited length, narrow ridge in the quilting cloth laminations, thereby facilitating the passage of a threaded needle through said ridge.

2. A quilting tool in accordance with claim 1 wherein said spoon shaped portion of said tool has a top end surface approaching a straight line having a length between 0.125 and 0.375 inches.

3. A quilting tool in accordance with claim 2 wherein said top end surface is formed on an outwardly projecting portion formed on said end of said spoon shaped tool portion.

4. A quilting tool in accordance with claim 1 wherein said handle portion has a configuration defined by a line movable in an arcuate path about the longitudinal axis of said handle portion.

5. The quilting tool of claim 4 wherein said handle portion has a circular cross-section.

* * * * *